US009797145B2

(12) United States Patent
Llapart Ramos

(10) Patent No.: US 9,797,145 B2
(45) Date of Patent: Oct. 24, 2017

(54) MODULAR METAL COVERING FOR BUILDINGS

(71) Applicant: GUIVES GIRONA, S.A., Celra (Girona) (ES)

(72) Inventor: Miquel Llapart Ramos, Celra (ES)

(73) Assignee: GUIVES GIRONA, S.A., Celra (Girona) (ES)

( * ) Notice: Subject to any disclaimer, the term of this patent is extended or adjusted under 35 U.S.C. 154(b) by 0 days.

(21) Appl. No.: 15/114,702

(22) PCT Filed: Jan. 23, 2015

(86) PCT No.: PCT/ES2015/070042
§ 371 (c)(1),
(2) Date: Aug. 8, 2016

(87) PCT Pub. No.: WO2015/110686
PCT Pub. Date: Jul. 30, 2015

(65) Prior Publication Data

US 2016/0348375 A1 Dec. 1, 2016

(30) Foreign Application Priority Data

Jan. 27, 2014 (ES) ..... 201430084

(51) Int. Cl.
*E04D 3/361* (2006.01)
*E04F 13/08* (2006.01)
(Continued)

(52) U.S. Cl.
CPC ..... *E04F 13/0892* (2013.01); *E04D 3/30* (2013.01); *E04D 3/363* (2013.01); *E04F 13/12* (2013.01); *E04F 2201/0146* (2013.01)

(58) Field of Classification Search
CPC ..... E04D 3/30; E04D 3/363; E04F 13/0892; E04F 2201/0146
(Continued)

(56) References Cited

U.S. PATENT DOCUMENTS 3,127,962 A * 4/1964 James ..... E04D 3/362 160/235
3,511,011 A * 5/1970 Straus ..... E04D 3/30 52/478
(Continued)

FOREIGN PATENT DOCUMENTS

DE 4125900 A1 * 2/1993 ..... E04D 3/362
DE 19900285 A1 * 7/2000 ..... E04D 3/30
(Continued)

OTHER PUBLICATIONS

International Search Report dated Apr. 6, 2015 for PCT/ES2015/070042 and English translation.
(Continued)

*Primary Examiner* — Charles A Fox
*Assistant Examiner* — James Buckle, Jr.
(74) *Attorney, Agent, or Firm* — Lucas & Mercanti, LLP

(57) ABSTRACT

The invention relates to a modular metal covering for buildings, consisting of successive metal sheets (1) which are interconnected by means of joining corresponding bends in the edges thereof, said connections being supported and fastened on supports (2), a lower groove (6) determining the bending of the edges of the metal sheets (1), wherefrom a vertical section extends, ending in a downward-oriented upper break, wherefrom one of the bends extends upwards, successively determining a bowed wing (9), a horizontal section (10) and a vertical section (11), while the other bend extends from the upper break with a wing (12) defining a domed shape; each support (2) comprising a body in the
(Continued)

form of a column which determines structures to which said bends of the metal plates (1) are fitted.

5 Claims, 7 Drawing Sheets

(51) Int. Cl.
*E04D 3/363* (2006.01)
*E04D 3/30* (2006.01)
*E04F 13/12* (2006.01)

(58) Field of Classification Search
USPC ..... 52/588.1
See application file for complete search history.

(56) References Cited

U.S. PATENT DOCUMENTS 4,223,503 A * 9/1980 Hague ..... E04D 3/38 52/394
4,266,385 A * 5/1981 Oehlert ..... E04D 3/362 52/521
5,524,409 A * 6/1996 Kaiser ..... E04D 3/362 52/537
6,289,646 B1 * 9/2001 Watanabe ..... E04F 13/083 52/235
6,354,045 B1 * 3/2002 Boone ..... E04D 3/366 52/395
7,603,825 B2 * 10/2009 Dohren ..... E04C 3/29 52/309.16
8,590,235 B2 * 11/2013 Resso ..... E04D 3/366 52/173.3
8,793,951 B2 * 8/2014 Resso ..... E04D 3/366 52/173.3
9,206,606 B2 * 12/2015 Jaks ..... E04D 3/362
2003/0106277 A1 * 6/2003 Heusel ..... E04D 3/362 52/536

FOREIGN PATENT DOCUMENTS

DE WO 2004022877 A1 * 3/2004 ..... E04C 3/29
DE WO 2005040519 A1 * 5/2005 ..... E04D 3/362
DE WO 2016156218 A1 * 10/2016 ..... E04F 13/0807
EP 0306880 A1 3/1989
EP 1489245 A1 12/2004
EP 2105549 A1 9/2009
ES 2125376 T3 3/1999
ES 2229579 T3 4/2005
WO 2009026655 A1 3/2009

OTHER PUBLICATIONS

Written Opinion dated Apr. 6, 2015 for PCT/ES2015/070042 and English translation.

* cited by examiner

MODULAR METAL COVERING FOR BUILDINGS

CROSS REFERENCE TO RELATED APPLICATIONS

This Application is a 371 of PCT/ES2015/070042 filed on Jan. 23, 2015, which, in turn, claimed the priority of Spanish Patent Application No. 201430084 filed Jan. 27, 2014, both of which are incorporated herein by reference.

TECHNICAL FIELD

The present invention relates to coverings for buildings that comprise a series of metal sheets that are successively arranged one after the other, proposing a covering of this type with embodiment features that guarantee a perfect impermeability and secure assembly, which, moreover, results in a covering with a simple installation.

BACKGROUND

Coverings for buildings must comply with essential requirements for a simple assembly that is lightweight, impermeable and reliable, with the goal of effectively protecting the surface of the covering, without requiring a supporting structure that is excessively strong.

There are conventional coverings that are formed by placing covering elements on a flat surface, such as tiles, slate or waterproof membrane, and these types of coverings are widely used. However, due to the types of materials these coverings are made up of, there are several inconveniences to them, such as the heavy weight, the need to have a support surface for the assembly and a very tedious installation.

There are also coverings made up of lightweight, plastic plates, or of other similar materials, the plates fastened by elements that require through holes on the plates. These types of coverings are light, only requiring support points to be fastened, and the assembly and installation are done quickly, since each plate covers a large area. However, due to the type fastening elements used, the installation is complicated and the holes for fastening the plates increase the risk of leakage through said holes.

There are alternative solutions for coverings by using metal sheets with bends by which the sheets are joined together and fastened to supports, such that the interconnected bends of the sheets make is so that each sheet overlaps the next one, thereby creating an impermeable connection between the sheets. For example, some solutions of this type are those described in the following patents: ES 2 125 376 T3, ES 2 217 061 T3, ES 2 229 579 T3, ES 2 329 844 T3 and ES 2 322 667 T3. However, all of these solutions are based on assemblies of metal sheets that are complex and expensive to manufacture and, furthermore, in some cases they do not guarantee a secure connection with proper sealing.

OBJECT OF THE INVENTION

In accordance with the present invention, a modular metal covering for buildings is presented which comprises structural features that allow for a simple assembly of the covering and guarantee a perfect impermeability and a highly secure installation.

This covering, which is the object of the invention, is made up of metal sheets, each one of which comprises a flat central surface and bends on the two opposite edges constituting the joining structures for the metal sheets, and supports that comprise a central body in the form of a column, with a base structure on the lower end, and the upper end in a "T"-shaped structure, the wings of which determine a small nook on the lower face at a certain distance below said "T"-shaped structure above grooves on either side of the central body.

The bends of the assembly of the metal sheets extend along the flat central surface, each one of said sheets forming a lower groove preceded by a small projection and a vertical section that extends from said lower groove, ending in a slightly downward-oriented upper break, wherefrom on one of the bends a bowed wing that turns back on itself extends upwards until it reaches a horizontal section that ends with a vertical tab, while on the other end a wing defining a domed shape extends upwards from the upper break, ending with an inward-facing tab.

In this way, in the assembly of a covering, the metal sheets are supported by an assembly with the bends of their edges on the supports, establishing an opposing double fit through the lower groove and the upper break of the bends between the grooves of the sides of the central body of the supports and the nooks of the lower face of the branches of the upper "T"-shaped structure, while the dome-shaped wing of the bends of one of the metal sheets establishes a fastening element of retention through its terminal tab with respect to said "T"-shaped structure above the structure of the supports, the bends of the edges corresponding to the consecutive metal sheets on said connection over the overlapping supports, thereby resulting in a very simple assembly of the installation and allowing the metal sheets to be securely fastened, in addition to a perfectly sealed connection between them.

Therefore, said covering, which is the object of the invention, has features that are clearly advantageous, taking on its own style and a preferred status with respect to the embodiments of coverings of the same type.

DETAILED DESCRIPTION OF THE INVENTION

Figure 1:
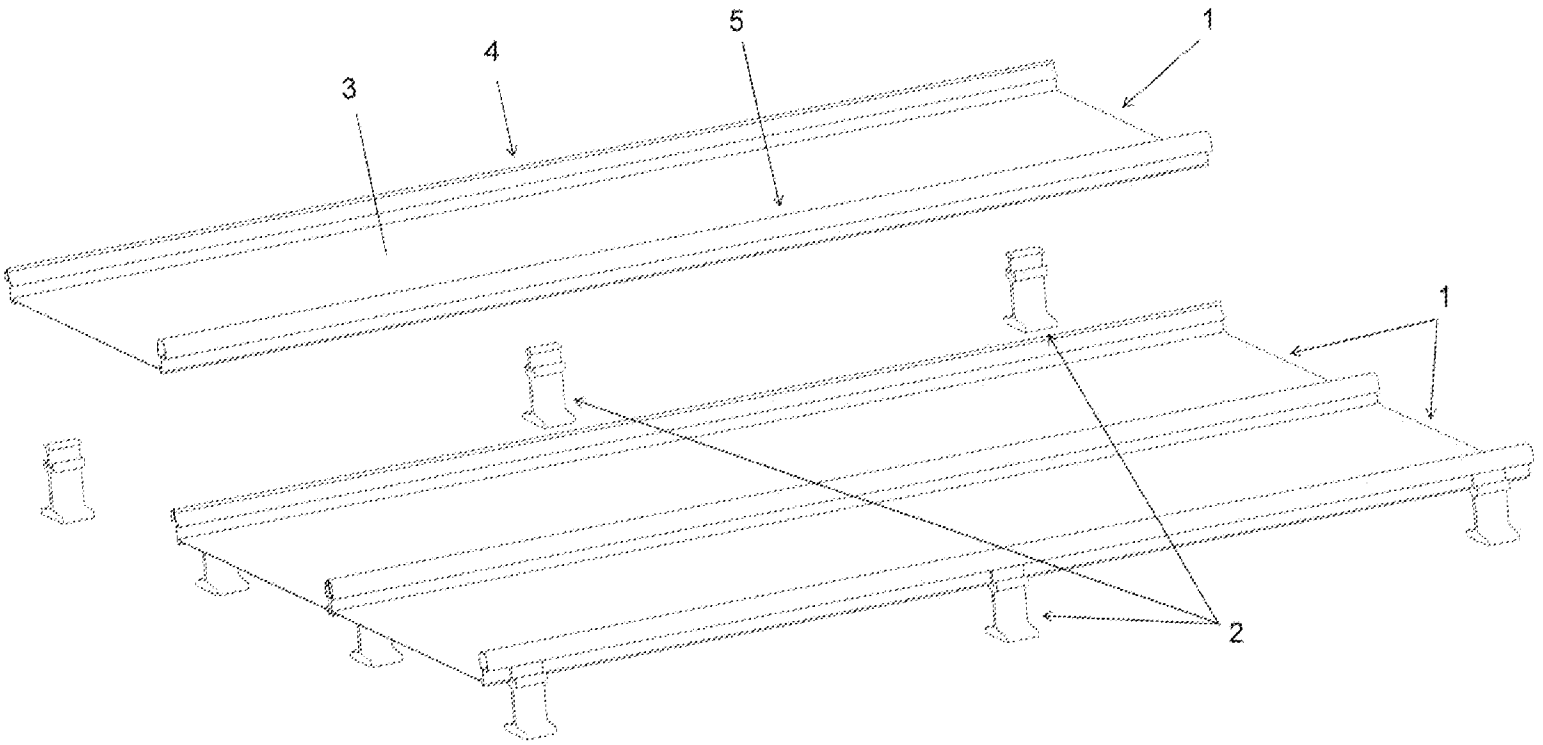
FIG. 1 shows a perspective view, one part of which is exploded, of an embodiment of the recommended covering with supports at a specific height.
Figure 2:
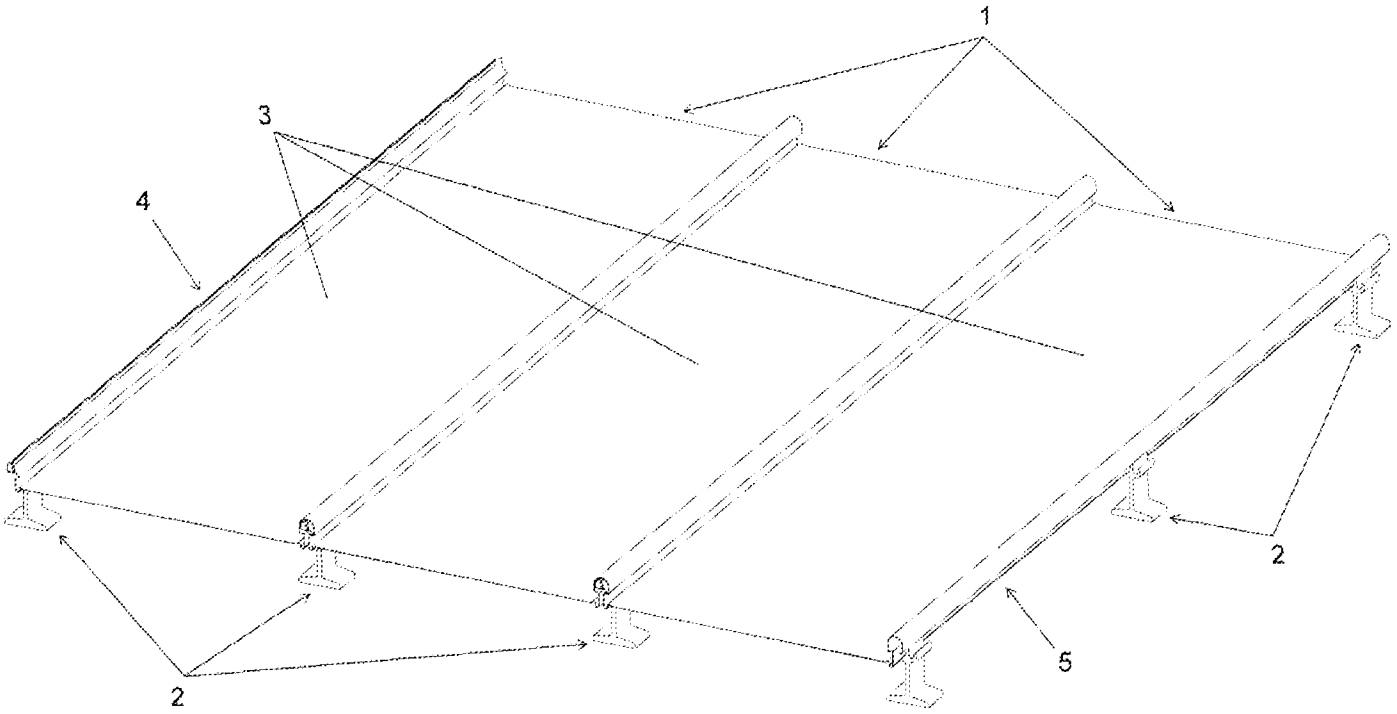
FIG. 2 shows a perspective view of the aforementioned cover assembled.

The object of the invention refers to a modular metal covering for buildings, of the type that are made up of metal sheets (1) which are interconnected successively, one after the other, in relation to supports (2) with characteristics of the embodiment that allow the successive metal sheets (1) to be effectively and reliably fastened, thereby achieving an efficient overlap between them, without the need for holes for fastening elements, guaranteeing a perfect impermeability and security for the covering, in addition to a quick and simple assembly.

Each metal sheet (1) of the covering's composition comprises a flat central surface (3), forming a bend (4) throughout the length of the edge for assembly and to be supported by the supports (2), and forming along the opposite edge a bend (5) to be assembled and fastened to the supports (2), such that both bends (4 and 5) form a lower groove (6) at their beginning, preceded by a small projection (7) with respect to the flat central surface (3) of the metal sheet (1), and from that groove (6) each one of the bends (4 and 5) defines a vertical section that ends at an upper break (8) defined by a slight declination, wherefrom the bend (4) extends upwards with a bowed wing (9) that turns back onto itself until it reaches a horizontal section (10) that ends with a vertical tab (11), while the bend (5) extends from the upper break (8) with a wing (12) that defines a domed shape that ends with an inward-facing tab (13).

Each support (2) comprises a central body (14) in the form of a column, which begins at a lower base formation (15), said central body (14) determining a "T"-shaped structure (16) in its upper end, whose branches define a small nook in the lower face, the end of one of the branches having a vertically curved beveled cut, while at a certain distance below said "T"-shaped structure (16), on the sides of the central body (14), there are grooves (17) that end at a protruding edge (18), said grooves (17) possibly in a "T"-shaped structure (19) configured at an intermediate height of the central body (14), as in the embodiments of FIGS. 1 to 5, or in the structure (15) of the base support (2), as well as in the embodiment of FIGS. 6 and 7.

Figure 3:
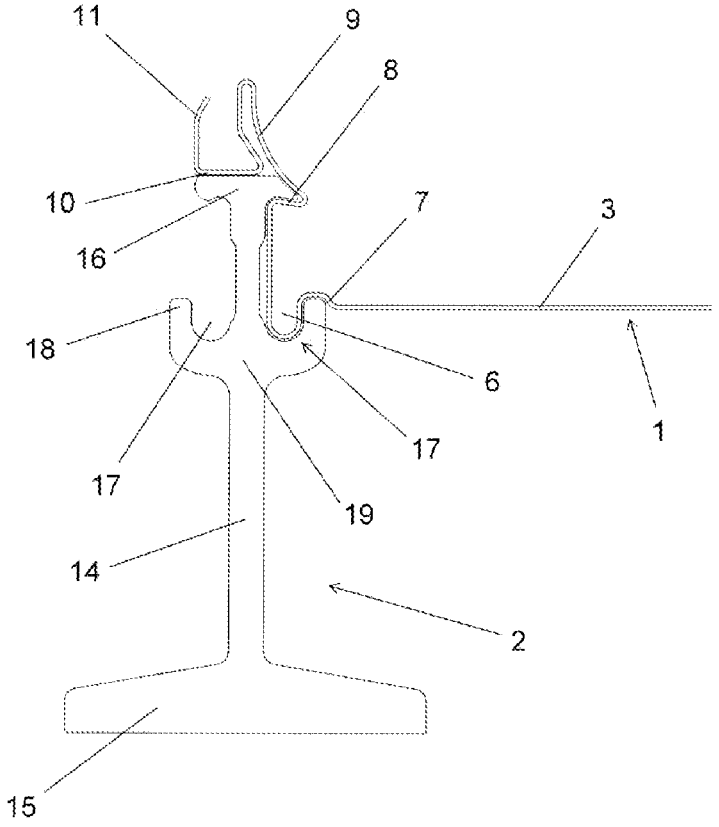
FIG. 3 shows a detailed view of the assembly of a metal sheet on a support through the bend of an edge.

In the assembly of the covering, the metal sheets (1) are arranged with the bends (4 and 5) of their edges over both rows of support (2), providing support with the horizontal section (10) of the bend (4) of one of the edges over the corresponding supports (2) and fitting with the lower groove (6) and the respective projection (7) in the groove (17) and the respective protruding edge (18) of one side of said supports (2), while the upper break (8) of said bend (4) fits in the nook of the lower face of the branch of that side of the "T"-shaped structure (16) above of the supports (2), as can be seen in FIG. 3.

Figure 4:
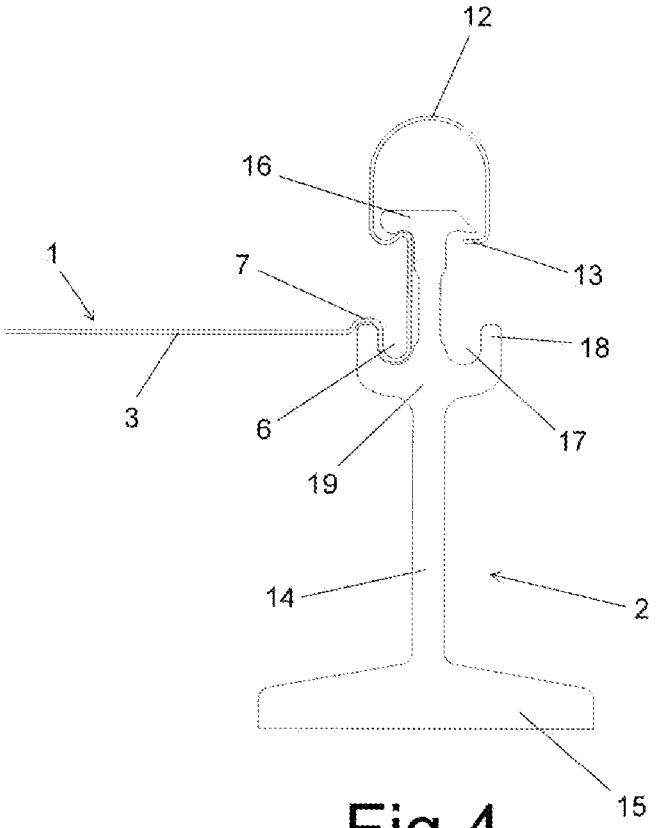
FIG. 4 shows a detailed view of the assembly of a metal sheet on a support through the bend of the opposite edge to that of the previous figure.

On the other side, the metal sheets (1) are arranged to fit with the lower groove (6) and the respective projection (7) of its bend (5) of the other edge on the groove (17) and the respective protruding edge (18) of the other side of the corresponding supports (2) and the upper break (8) of said bend (5) fitting in the nook of the lower face of the branch of that side of the "T"-shaped structure (16) above said supports (2), the dome-shaped wing (12) of the aforementioned bend (5) being above the "T"-shaped structure (16) above the supports (2), such that the terminal tab (13) of that dome-shaped wing (12) fits in the edge of the branch of the other side of the mentioned "T"-shaped structure (16) above the supports (2), as can be seen in FIG. 4.

Figure 5:
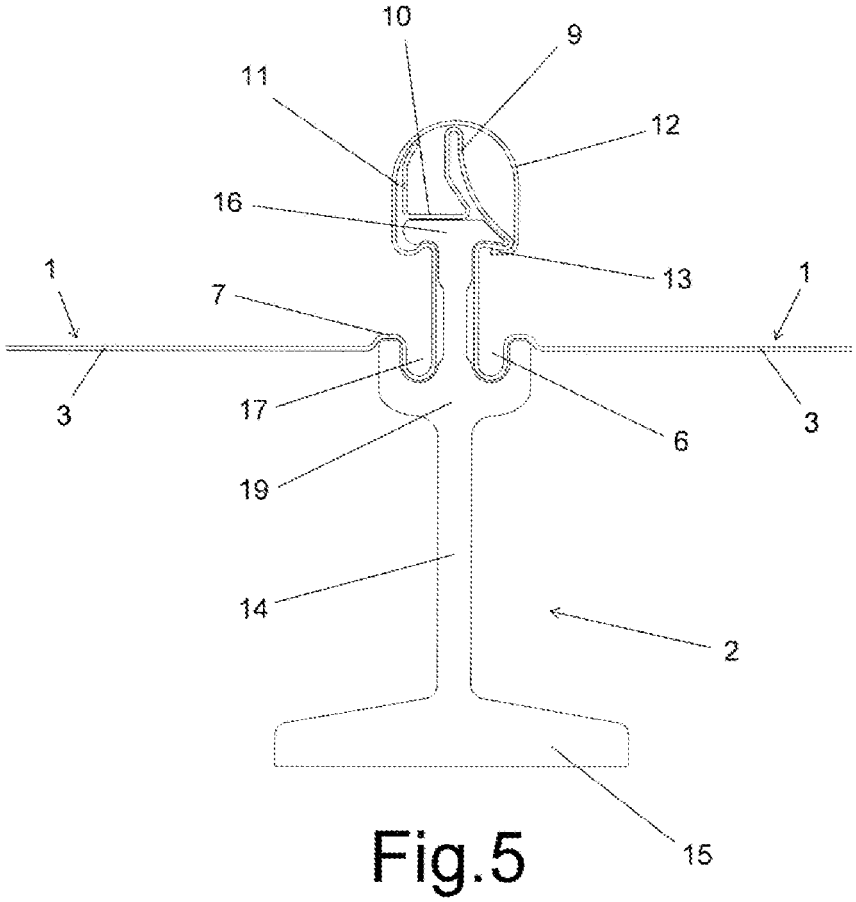
FIG. 5 shows a detailed view of the assembly of two metal sheets, which are components of a covering, according to the invention.

With this arrangement in the assembly, the assembly of two consecutive metal sheets (1) is done on one row of supports (2), with one of the metal sheets (1) with its bend (4) on one side of the supports (2) and the other metal sheet (1) with its bend (5) on the other side of the same supports (2) such that the dome-shaped wing (12) of the bend (5) of the second metal sheet (1) is on top and butting up against the wing (9) and the tab (11) of the upper part of the bend (4) of the first metal sheet (1), as can be seen in FIG. 5.

This way, each one of the metal sheets (1) is individually and securely fastened to the supports (2), thanks to the opposing double fit established by the lower grooves (6) and the upper breaks (8) of the bends (4 and 5) with respect to the metal sheets (1), in relation to the corresponding grooves (17) and the projections of the lower face of the wings of the "T"-shaped structure (16) above the supports (2), as well as the fastening element of the tab (13) of the dome-shaped wing (12) with respect to the aforementioned "T"-shaped structure (16) above the supports (2).

Moreover, between the metal sheets (1) is a perfectly sealed connection due to the upper cover the dome-shaped wing (12) provides above the connection and at the height of upper edge of the bend (4) in the interior of the aforementioned domed-shape wing (12) covering the connection.

The supports (2) may be arranged on a forged platform above the buildings where the cover is to be applied, or directly on the structure of the structural frame of the buildings, with the possibility of using supports (2) with grooves (17) formed in a structure (19) located at an intermediate height of the central body (14), as well as in the embodiment of FIGS. 1 to 5, in this case below the arrangement of the metal sheets (1), in the assembly of the covering, a hole that allows an insulating material to be included.

Figure 6:
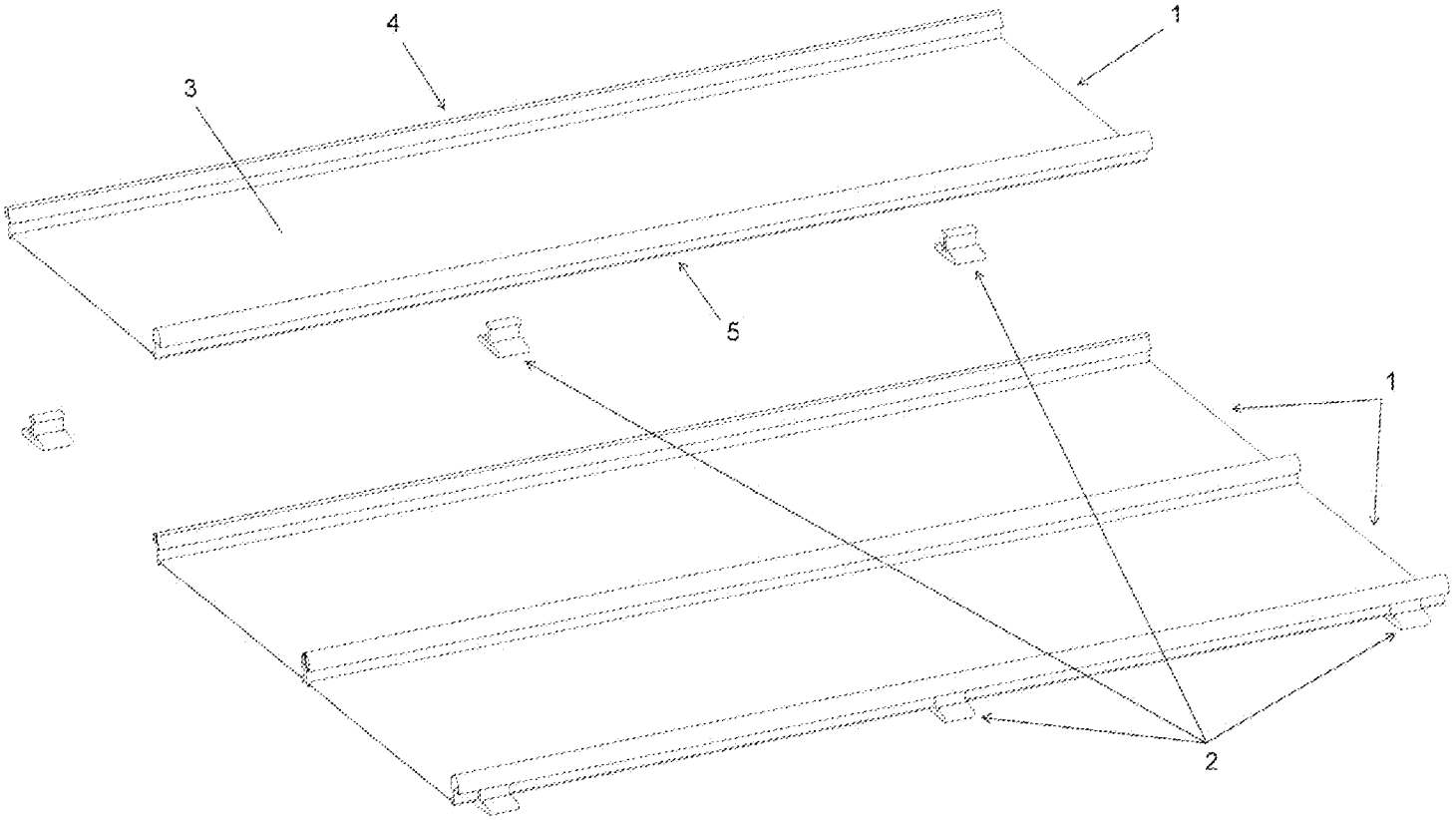
FIG. 6 shows a perspective view, one part of which is exploded, of another embodiment of the recommended covering with supports at low heights.
Figure 7:
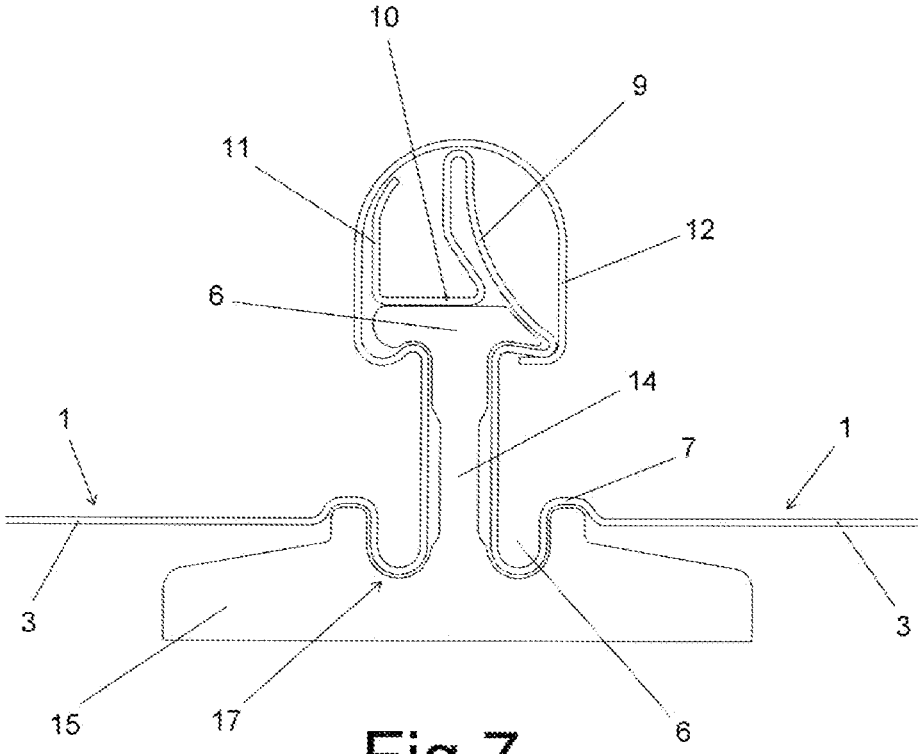
FIG. 7 shows a detailed view of the assembly of two metal sheets, which are components of a covering, in the embodiment of the previous figure.

However, when a layer of an insulating material is not going to be included under the covering, supports (2) at a lower height may be used, with the grooves (17) formed in the lower structure (15) of the base, as in the embodiment of FIGS. 6 and 7.

The invention claimed is:

1. A modular metal covering system comprising:

a plurality of supports, each support comprising:

a base adapted to rest on a surface;

a vertical column disposed on the base;

a T-shaped structure disposed on an end of the column, the T-shaped structure having first and second arms extending perpendicularly from the vertical column;

a first branch attached to the column, the first branch having a first branch portion that extends in a first direction away from the column between the base and the T-shaped structure and a first tip portion extending from the first branch portion in a second direction different from the first direction, wherein the column, the first branch portion, and the first tip portion define a first hollow configured in such a manner that the first branch portion is between the first hollow and the base; and a second branch attached to the column, the second branch having a second branch portion that extends in a third direction away from the column between the base and the T-shaped structure and a second tip portion extending from the second branch portion in a fourth direction different from the third direction, wherein the column, the second branch portion, and the second tip portion define a second hollow configured in such a manner that the second branch portion is between the second hollow and the base;

a plurality of metal sheets, each metal sheet having a surface portion, a first connection on a first side of the surface portion, and a second connection on a second side of the surface portion opposite the first side, each of the first and second connections being adapted to connect to one of the plurality of supports, wherein:

the first connection comprises a first raised projection adapted to fit over one of the first and second tip portions of a support, a first groove portion joined to the first raised projection, the first groove portion adapted to fit into one of the first and second hollows of a support, a first vertical section joined to the first groove portion, the first vertical section being perpendicular to the surface portion, a first upper break joined to the first vertical section, the first upper break comprising a segment that forms an acute angle with the first vertical section, the first upper break adapted to fit around one of the first and second arms of a support, and a dome-shaped section joined to the first upper break, and a tab joined to the dome-shaped section, and the second connection comprises a second raised projection adapted to fit over one of the first and second tip portions of a support, a second groove portion joined to the second raised projection, the second groove portion adapted to fit into one of the first and second hollows of a support, a second vertical section joined to the second groove portion, the second vertical section being perpendicular to the surface portion, a second upper break joined to the second vertical section, the second upper break comprising a segment that forms an acute angle with the second vertical section, the second upper break adapted to fit around one of the first and second arms of a support, and a folded section joined to the second upper break, the folded section comprising a curved segment joined to the second upper break, a bent segment joined to the curved segment, a first straight segment joined to the bent segment, and a second straight segment joined to the first straight segment;

wherein:

the second groove portion of the second connection of a first metal sheet fits into the first hollow of a support and the folded section of the second connection of the first metal sheet is disposed on the T-shaped structure of the support; and the first groove portion of the first connection of a second metal sheet fits into the second hollow of the support and the dome-shaped section of the second connection of the second metal sheet fits over the folded section of the first connection of the first metal sheet.

2. The modular metal covering system according to claim 1, whereinthe first straight segment is adapted to rest on the T-shaped structure, and the second straight segment is perpendicular to the first straight segment.

3. The modular metal covering system according to claim 1, wherein:

the base has a bottom side adapted to rest on the surface;

a smallest distance between a second surface of the first hollow and the bottom side of the base is smaller than a greatest distance between a second surface of the first tip portion and the bottom side of the base; and a smallest distance between a third surface of the second hollow and the bottom side of the base is smaller than a greatest distance between a fourth surface of the second tip portion and the bottom side of the base.

4. The modular metal covering system according to claim 1, wherein the first arm of the T-shaped structure has a sloped portion, and the second upper break and the curved segment are adapted to fit around the first arm.

5. A modular metal covering system comprising:

a plurality of supports, each support comprising:

a base having a first side and a second side, the first side being adapted to rest on a surface;

a vertical column disposed on a second side of the base;

a T-shaped structure disposed on an end of the column, the T-shaped structure having first and second arms extending perpendicularly from the vertical column;

wherein the second side of the base comprises:

a first projecting portion disposed at a non-zero distance from the vertical column, and a first hollow defined between the vertical column and the first projecting portion, wherein a smallest distance between a first surface of the first hollow and the first side of the base is smaller than a greatest distance between a second surface of the first projecting portion and the first side of the base;

a second projecting portion disposed at a non-zero distance from the vertical column, and a second hollow defined between the vertical column and the second projecting portion, wherein a smallest distance between a third surface of the second hollow and the first side of the base is smaller than a greatest distance between a fourth surface of the second projecting portion and the first side of the base;

a plurality of metal sheets, each metal sheet having a surface portion, a first connection on a first edge of the surface portion, and a second connection on a second edge of the surface portion opposite the first edge, each of the first and second connections being adapted to connect to one of the plurality of supports, wherein:

the first connection comprises a first raised projection adapted to fit over one of the first and second projecting portions of a support, a first groove portion joined to the first raised projection, the first groove portion adapted to fit into one of the first and second hollows of a support, a first vertical section joined to the first groove portion, the first vertical section being perpendicular to the surface portion, a first upper break joined to the first vertical section, the first upper break comprising a segment that forms an acute angle with the first vertical section, the first upper break adapted to fit around one of the first and second arms of a support, and a dome-shaped section joined to the first upper break, and a tab joined to the dome-shaped section; and the second connection comprises a second raised projection adapted to fit over one of the first and second projecting portions of a support, a second groove portion joined to the second raised projection, the second groove portion adapted to fit into one of the first and second hollows of a support, a second vertical section joined to the second groove portion, the second vertical section being perpendicular to the surface portion, a second upper break joined to the second vertical section, the second upper break comprising a segment that forms an acute angle with the second vertical section, the second upper break adapted to fit around one of the first and second arms of a support, and a folded section joined to the second upper break, the folded section comprising a curved segment joined to the second upper break, a bent segment joined to the curved segment, a first straight segment joined to the bent segment, and a second straight segment joined to the first straight segment;

wherein:

the second groove portion of the second connection of a first metal sheet fits into the first hollow of a support and the folded section of the second connection of the first metal sheet is disposed on the T-shaped structure of the support; and the first groove portion of the first connection of a second metal sheet fits into the second hollow of the support and the dome-shaped section of the second connection of the second metal sheet fits over the folded section of the first connection of the first metal sheet.

* * * * *